United States Patent [19]

Wallwork

[11] 4,026,345

[45] May 31, 1977

[54] FOUNDRY MOULDING

[76] Inventor: Charles Michael Geoffrey Wallwork, Church Cottage, Birtles Lane, Over Alderley, Cheshire, England

[22] Filed: June 26, 1975

[21] Appl. No.: 590,714

[30] Foreign Application Priority Data

June 26, 1974 United Kingdom ..... 28262/74

[52] U.S. Cl. ..... 164/202; 164/201; 164/213

[51] Int. Cl.[2] ..... B22C 15/22

[58] Field of Search ..... 164/200, 201, 202, 16, 164/18, 181, 213

[56] References Cited

UNITED STATES PATENTS

| | | | |
|---|---|---|---|
| 2,871,527 | 2/1959 | Wallwork | 164/16 |
| 2,882,565 | 4/1959 | Selby | 164/201 |
| 3,121,593 | 2/1964 | McIlvaine | 164/200 |
| 3,303,535 | 2/1967 | Rearwin et al. | 164/172 |
| 3,327,767 | 6/1967 | Wallwork | 164/18 |
| 3,433,285 | 3/1969 | Fellows | 164/213 |
| 3,744,550 | 7/1973 | Larkin | 164/172 |
| 3,838,731 | 10/1974 | Abraham et al. | 164/181 |

*Primary Examiner*—Leonidas Vlachos
*Attorney, Agent, or Firm*—Scrivener Parker Scrivener & Clarke

[57] ABSTRACT

In a machine for the automatic production of flaskless foundry molds by a blow-squeeze method between opposed pattern plates in an opening in a slider which then moves to carry the newly formed mold clear of its point of production, to a point where it is ejected, the slider moves vertically and the point of ejection is vertically below the point of production. Preferably both pattern plates are actuated by a single ram assembly which lies to one side of the slider, being connected to the pattern plate on the other side through tie-rods.

12 Claims, 7 Drawing Figures

FOUNDRY MOULDING

This invention relates to the automatic production of foundry moulds. The normal method of producing foundry moulds involves the use of flasks or boxes in which individual copes and drags are made and are then brought together in pairs. Although a considerable degree of mechanical handling of the flasks has been introduced these still involve a substantial outlay in space and have to be stored and recirculated. Proposals have been made, and indeed widely adopted, for making moulds without flasks, for example using shell-moulding techniques, and there is also my own earlier proposal forming the subject of my U.S. Pat. No. 2,871,527. In this proposal double-sided flaskless moulds are formed by a blowing technique and compacted by squeeze pressure, and then formed into lines with their mating faces vertical. Extremely high production rates are possible by this technique. In the preferred embodiment described in that earlier patent specification the moulds are ejected at alternate sides of the machine onto two tracks. Also in that previous proposal of mine each double-faced flaskless mould was formed by squeezing a blown body of sand between opposed pattern plates mounted on separate rams.

In another earlier proposal the one pattern plate was held stationary whilst the other pattern plate was mounted on a ram and urged towards the stationary one to squeeze and compact the mould but the use of a stationary plate resulted in uneven compaction across the thickness of the mould which severely limited the thickness of mould that could be made in this way.

The aim of the present invention is to provide a simplified and more economical machine of the same basic type as our own earlier proposal, for use where a lower rate of production is acceptable and where possibly space is at a premium.

According to the invention, in an automatic machine of the kind described for the production of flaskless foundry moulds, with the pattern plates moving into the opening in a horizontal direction, the slider or frame is movable in a vertical downward direction, after withdrawal of the pattern plates from the opening, to carry the newly formed mould clear of its point of production. An ejector ram for enjecting the moulds from the opening is preferably vertically below the power means that actuate the pattern plates, resulting in a very compact structure.

A significant advantage of the vertical movement of the frame, mentioned above, is that the blowing head can remain fixed, unlike that of the proposal in our earlier Patent Specification, in which the heads has to be lifted vertically before the frame could be displaced.

The slider or frame preferably has only a single opening for forming a moulding chamber.

The two pattern plates may be moved simultaneously in opposite directions into the opening in the slider or frame by means of a single fluid-pressure ram assembly forming the said power means. For example the ram assembly may comprise a pair of pistons arranged back-to-back and each operating one of the pattern plates, or a piston and cylinder, the piston acting on one of the pattern plates and the cylinder on the other. For example one of the pattern plates could be mounted directly on the end of the piston or ram, whilst the cylinder is connected through a pair of laterally spaced drawbars to ears on a plate that carries the other pattern plate. The drawbars are mounted on guides on the frame of the machine and they may serve to support the floating ram assembly, but the cylinder may also be supported in separate guides.

In this way I obtain a double-sided squeeze yet have a ram assembly on only one side of the machine leaving the other side, which is above the line of moulds, free for easy insertion of cores into the end mould of the line.

In one preferred embodiment the ejector ram has two strokes available, a shorter and a longer one, which are used alternately. In its shorter stroke the ram simply ejects the mould the minimum amount to clear the frame and then it retracts to allow the frame to return to its other end position. Then, while another mould is being blown, squeezed and drawn in the frame, the ejector ram advances a second time, this time with a longer stroke, to close the previously ejected mould onto the end of the line of moulds formed earlier, and to advance the whole bank of moulds by a distance equal to the thickness of a mould.

The blowing of the moulds can be done in the same way as in our earlier proposal, using a blowing head mounted above the moulding chamber and receiving a charge of sand from a measuring hopper above, the upper end of the head being closed off by a horizontally sliding shutter or sandgate before blowing.

Actual movement of the two pattern plates may be controlled by separate hydraulic piston and cylinder means associated with the piston and cylinder, respectively, of the single ram. For example, the cylinder of the ram and the pattern plate which is actuated by the piston of the ram may each carry pistons which work in fixed cylinders, the flow of hydraulic fluid out of the fixed cylinders controlling the rate of movement of the two pattern plates into the opening. Furhter, fluid can be supplied to the fixed cylinders to move the two pattern plates apart after a mould has been formed.

The invention will now be further described by way of example with reference to the accompanying drawings, in which.

Figure 2:
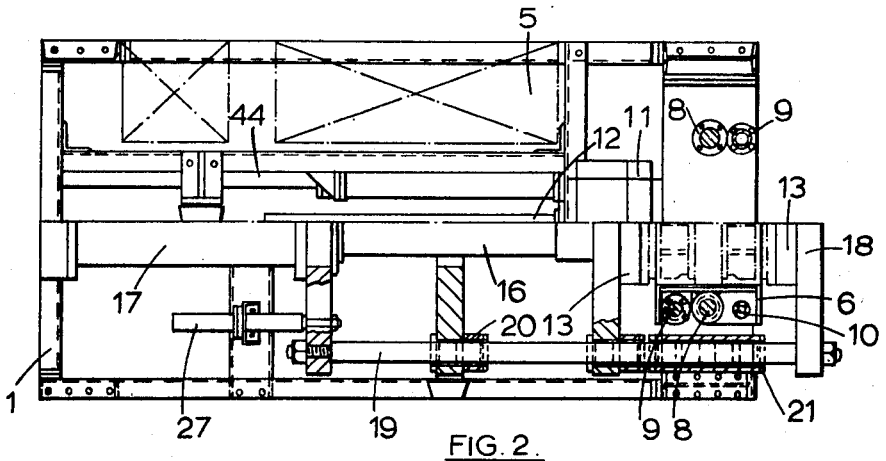
FIG. 2 is a composite horizontal section in two planes, the lower half being a section on the line B—B in FIG. 1 and the upper half being a section on the line C—C in FIG. 1.
Figure 3:
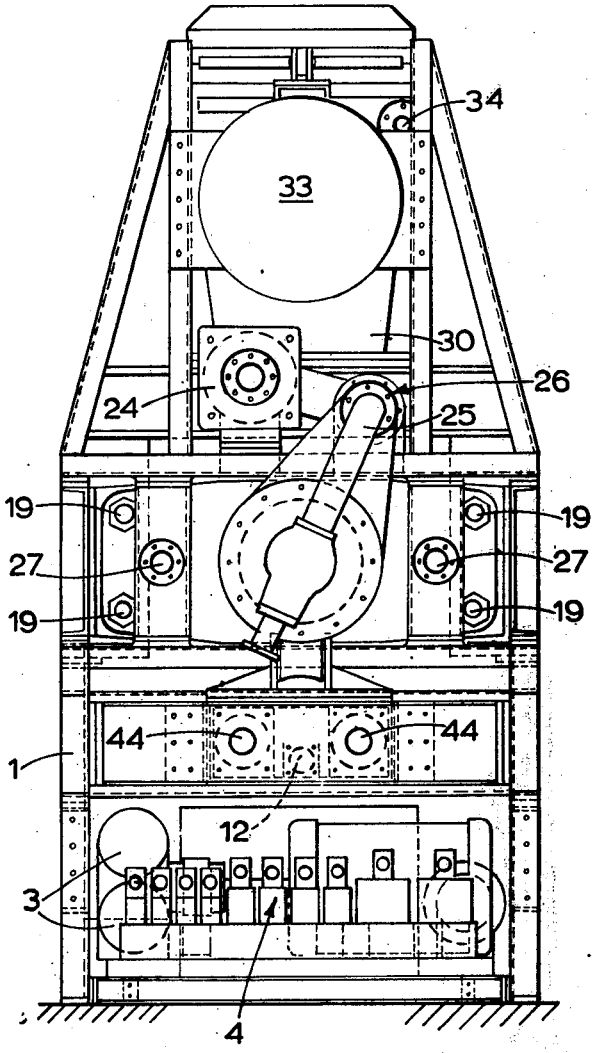
FIG. 3 is an end elevation of the machine looking from the left in FIG. 1.
Figure 4:
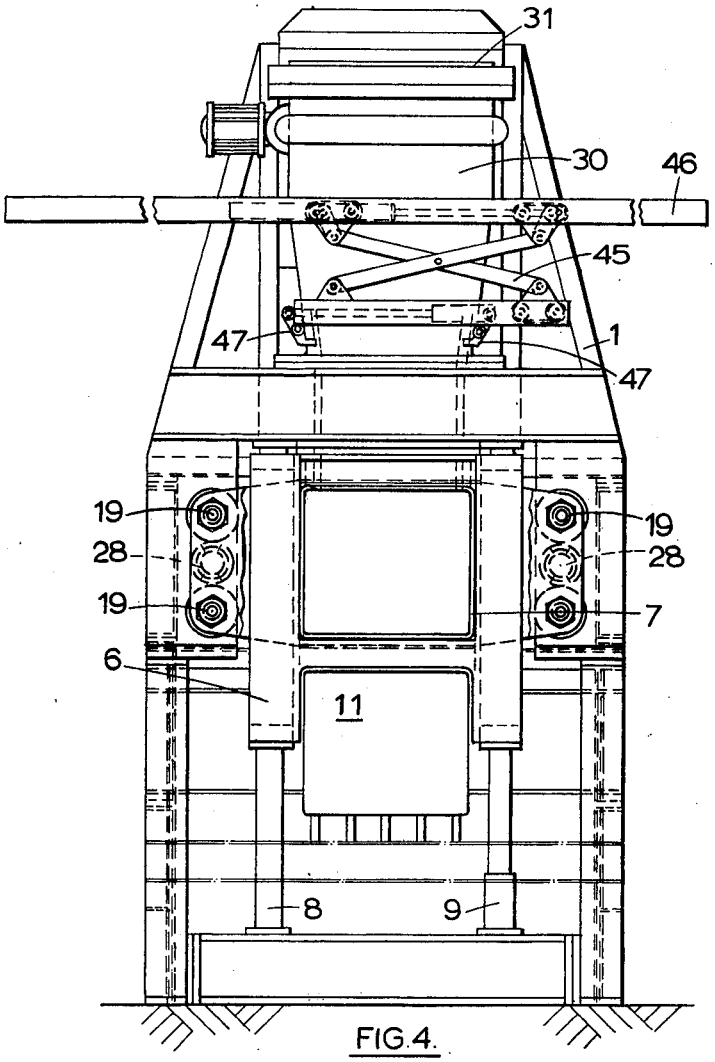
FIG. 4 is an end elevation looking from the right in FIG. 1.

The machine illustrated is of compact construction, comprising a basic frame 1, best seen in FIGS. 3 and 4, mainly of rolled channel sections in which all the components are mounted, including a hydraulic motor-driven hydraulic pump 2 and accumulators 3 to provide power for the various rams and the accompanying solenoid-operated valves 4, as well as the controlling electric timers and the pneumatic controls, indicated at 5 in FIG. 2, and a hydraulic fluid reservoir or tank T.

The heart of the machine lies in a frame or slider 6 having a single rectangular horizontal opening right through it, containing a replaceable liner 7. This slider is vertically movable on guides 8 by means of pairs of hydraulic rams 9 and 10 (two for upward movement and two for downward movement) between an upper position, as shown in the drawings, and a lower position in which the opening is aligned with a pad 11 on a hydraulic ejector ram 12, to be described later.

Co-operating with the opening in the frame 6 is a pair of opposed 13 carrying bolsters 14 on which are mounted pattern plates 15 carrying pattern impressions in the same ways as in our machine described in our earlier Patent Specification referred to above. In the present arrangement, however, the left-hand platen 13 is mounted directly on the piston or ram 16 of a hydraulic cylinder 17 and the right-hand platen 13 is connected through a transverse plate 18 (FIG. 2) and laterally spaced tie-rods 19 (FIGS. 2 and 4) of this same cylinder 17, which cylinder is itself movable in the direction of its axis. The four rods 19 also form supports and guides, sliding in bearing bushes 20 and 21 (FIG. 2) in the frame 1 and the cylinder is additionally supported underneath on a roller 22.

Figure 1:
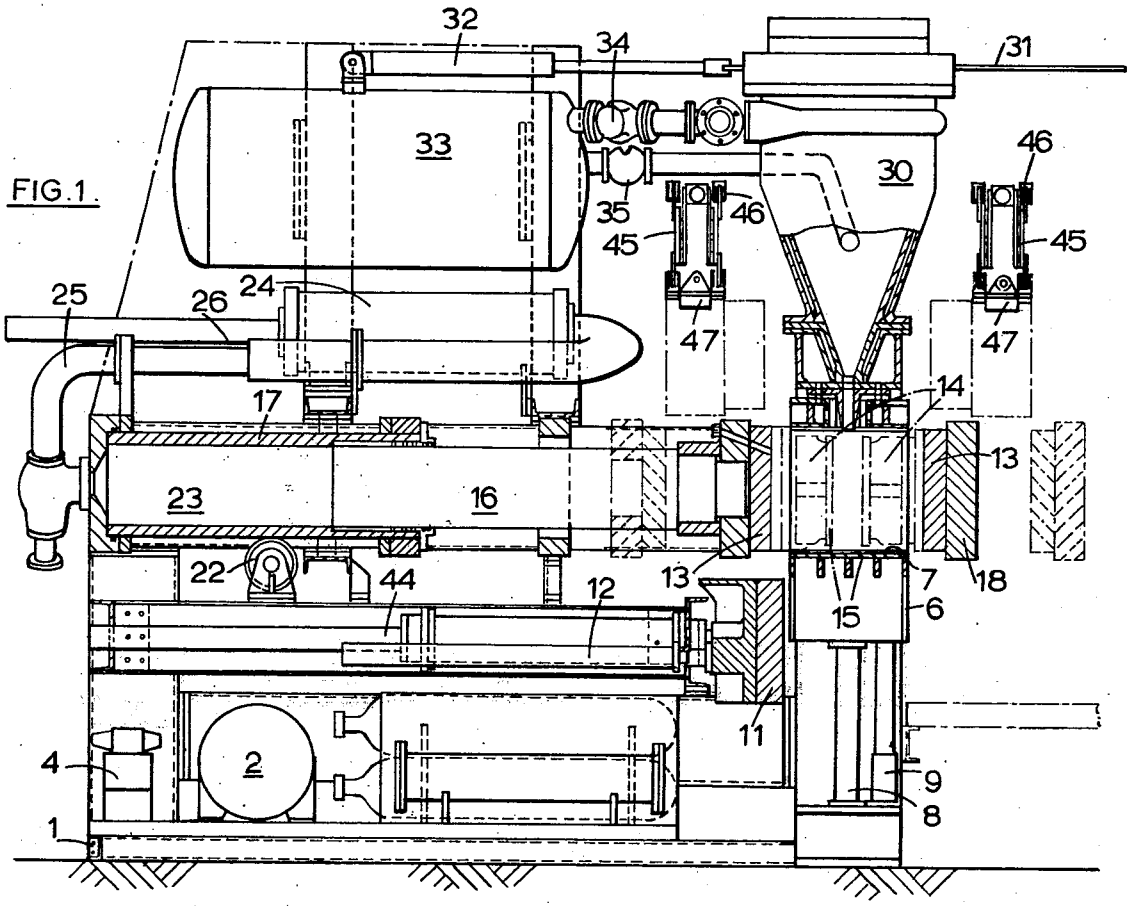
FIG. 1 is a partly sectioned side elevation of a moulding machine according to the invention.

It will be appreciated that the admission of hydraulic fluid into the chamber 23 of the cylinder 17 will cause the piston 16 to move to the right and the cylinder to move to the left, so that the pattern plates 15 move into the opening in the slider 6 from opposite sides to form a closed moulding chamber. Instead of a moving single-ended cylinder one could employ a fixed cylinder with two opposed pistons; in either case this leaves clear the space to the right of the slider, as viewed in FIG. 1, and this has advantages which will be referred to later. Hydraulic fluid is supplied to the cylinder 17 initially from a so-called "pre-fill" cylinder 24 containing a differential piston able to feed a substantial quantity of fluid at relatively low pressure through a rigid pipe 25 that incorporates a sliding seal at 26, thereby avoiding the necessity for a large flexible hose connection to the moving cylinder 17. The final movement of the cylinder 17 in the closing direction to squeeze the mould is achieved by the direct application of high pressure fluid, as will be described later with reference to FIG. 6.

To draw the pattern plates apart separate pairs of single acting rams are provided, one pair being visible at 27 in FIG. 3 and the other pair being visible at 28 in FIG. 4. One of the rams 27 is also visible in FIG. 2. As will be described, these rams also act to control the speed at which the closing movement takes place.

Sand is admitted to a blowing head 30 through a horizontally sliding sandgate 31 from a measuring hopper (not shown) under the control of a hydraulic ram 32. When the sandgate is closed it is sealed by the admission of air to a pneumatic seal (not shown) and then compressed air from a reservoir 33 mounted in the top part of the frame is admitted through valves 34 and 35 to the blowing head to shoot the charge of sand into the moulding chamber.

Figure 5:
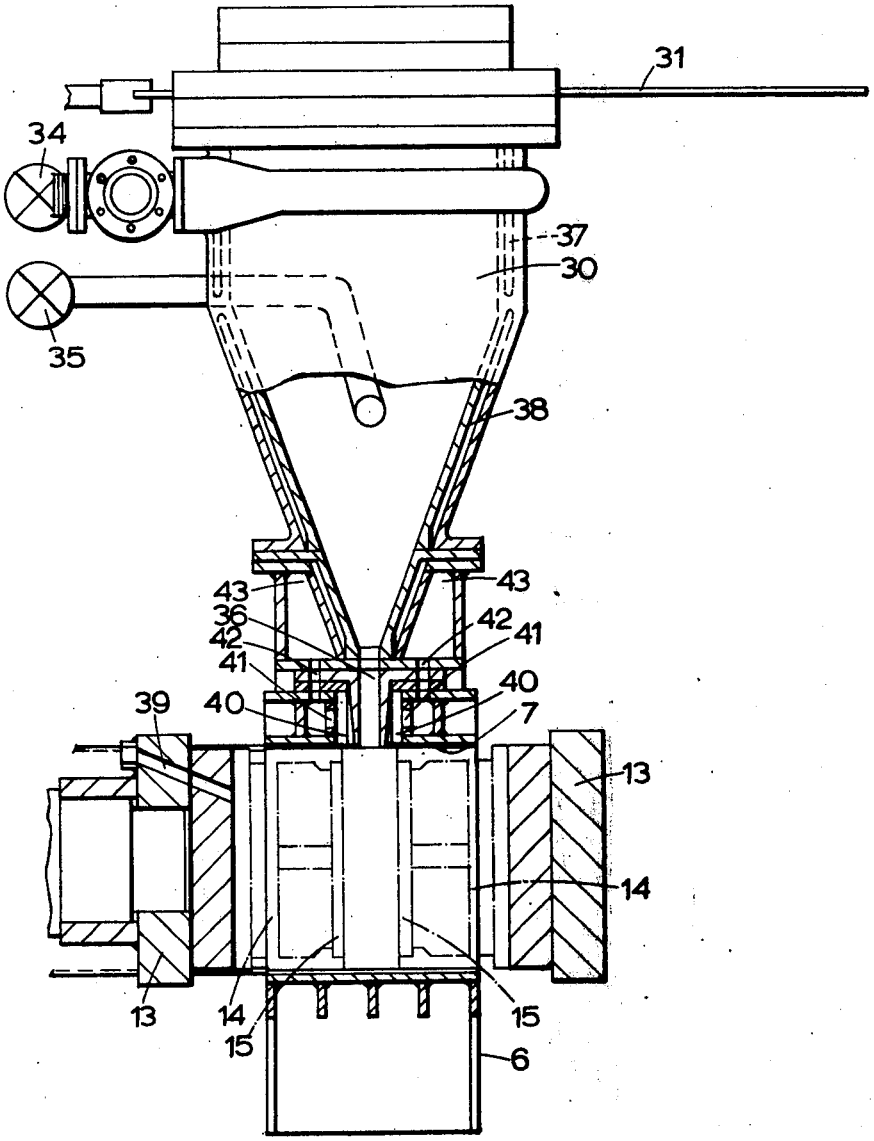
FIG. 5 shows the blowing head and moulding chamber to a large scale.

The details of the blowing head and moulding chamber are shown in FIG. 5. The blowing head is basically of known kind, having a downwardly convergent shape terminating in a nozzle 36 of elongate rectangular cross-section (as viewed in plan) that mates with a corresponding opening in the top of the liner 7, extending the full width of the liner. The wall of the blowing head, instead of having a single annular venting jacket for the admission of air from the reservoir 33, has an upper region 37 and a lower region 38, served independently by the respective valves 34 and 35. The reason for this is as follows:

In known sand-blowing heads, if the air is admitted only at the top of the chamber the sand tends to be compacted more firmly at the bottom of the moulding chamber than at the top, due to the decreasing force with which the sand is discharged through the nozzle as the evacuated volume of the blowing chamber increases. Equally, if the air is supplied uniformly through the whole depth of the side walls of the blowing chamber it fluidises the sand and initially the sand enters the moulding chamber gently. It is only when the majority of the vents are uncovered and the majority of the sand is already in the moulding chamber that the full force is applied, and so the mould tends to be compacted better at the top than at the bottom.

By separating the air admission vents into independently controlled upper and lower regions we can adjust the relative flow between them by means of the valves 34 and 35, so that the sand is compacted substantially uniformly throughout the depth of the moulding chamber in the slider 6. The best results are reached by trial and error, and in practice it is found that the supply to the lower portion has to be throttled rather more than that to the upper portion.

One problem that can arise with the formation of moulds by blowing the sand in at high speed is that of abrasion and consequent damage to the patterns 15. Although the nozzle 36 is shown as having parallel walls we find that this problem can be alleviated by making the nozzle of convergent-divergent form, that is to say, with an upper portion tapering convergently, like the main body of the blowing head, followed by a final portion of increasing cross-section. It is found that this produces a non-divergent stream of sand that largely avoids direct impact on the patterns.

A further point to note about the blowing head is the provision for venting the air that enters the moulding chamber along with the sand. Not only are there vents such as that shown at 39 in the platens (with holes, not shown, through the pattern plates) but also there are vents 40 in the liner 7 on each side of the nozzle 36, leading through venting passages 41 and 42 to outlet chambers 43 which are open to the atmosphere.

The peripheries of the pattern plates 15 are provided with channels all the way round (not shown), containing seals in the form of loops of polyurethane or similar synthetic resin tube to seal the pattern plates into the liner 7 and keep to a minimum the escape of air between these components, thereby keeping down the wear on the liner due to abrasion by particles of sand carried by the air into the clearance between these parts.

The pattern plates 15 are mounted in the bolsters 14 with a small amouunt of clearance and are located by set screws. This permits find adjustment of the lateral and vertical position of the patterns so that the pattern impressions on the mating faces of adjacent moulds, when they meet, are exactly aligned.

Vertically below the main cylinder 17 is the hydraulic ejector ram 12 referred to earlier and actuating the pad 11. The pad is guided and supported by a pair of laterally spaced guide rods 44 (FIGS. 1, 2 and 3) and it will be seen that the line of thrust of the ram 12 is slightly below the axes of the rods 44 to produce an upward component of force, counteracting the tendency of the rods to sag when the pad 11 is advanced the full extent to the right, as viewed in FIG. 1. The purpose of the ram 12 is to push each newly formed mould, in the form of a block of sand formed in the moulding chamber in the slider 6, out of the moulding chamber (after the slider has moved to its lower end position) to join a line of previously formed moulds to the right of the machine as viewed in FIG. 1. As each mould has pattern impressions in both vertical faces, a casting cavity is defined by the co-operating faces of each adjacent pair of moulds. This is the same basic principle as that employed in the layout forming the subject of our above-mentioned earlier Patent Specification, except that we form only a single line of moulds instead of two.

The absence of any mould-forming or squeezing ram to the right of the machine (as viewed in FIG. 1) means that space is available for the insertion of cores, either automatically or by hand, in the exposed face of the last mould in the line, despite the overall compactness of the machine and despite the fact that the axis of the line of moulds is vertically below the moulding-forming region.

Two alternative cycles are possible, a slower one which is simpler and a faster one which involves the ram 12 performing short and long strokes alternately. In the slower cycle, after the slider 6 has moved to its lower position the ram advances through the slider 6 to push the newly formed mould not only out of the moulding chamber but also up against the last mould of the existing line, and furthermore advances the whole line of moulds by a distance equal to the thickness of one mould. The ram then restracts and only when this retraction has been completed can the slider 6 be shifted upwards again to allow the blowing of a further mould.

In the faster cycle the ram 12 at first advances only far enough to push the newly formed mould out of the slider and then quickly retracts. The slider then shifts to its upper position, allowing the blowing of a new mould to take place without delay, while the ram advances a second time, this time below the slider and with a longer stroke, to carry the previously formed mould along to join the line and also to advance the line.

In a typical example the slower cycle is capable of producing 360 moulds per hour, whereas by the faster cycle we can produce 450 moulds per hour.

Figure 7:
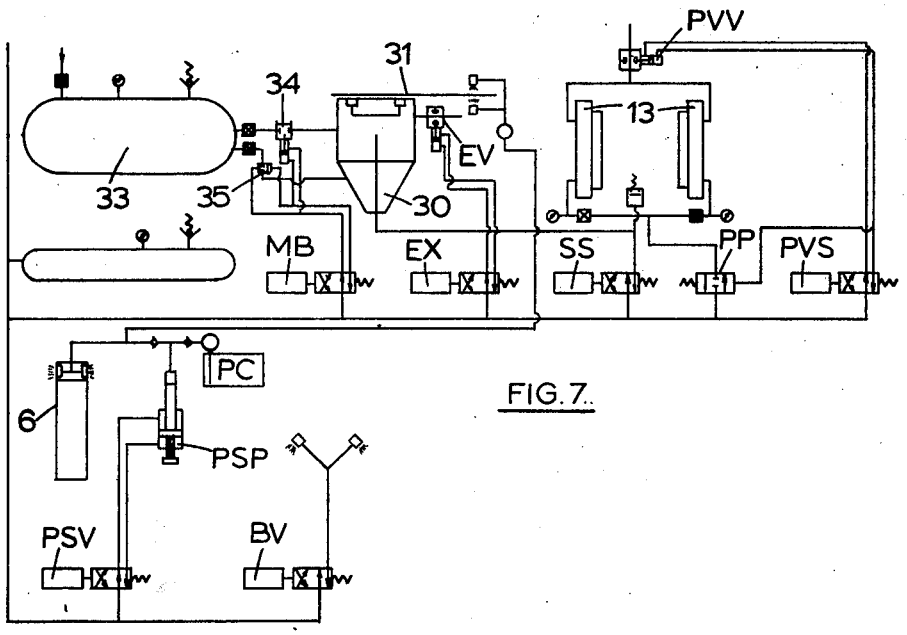
FIG. 7 shows the basic layouts of the pneumatic system.
Figure 6:
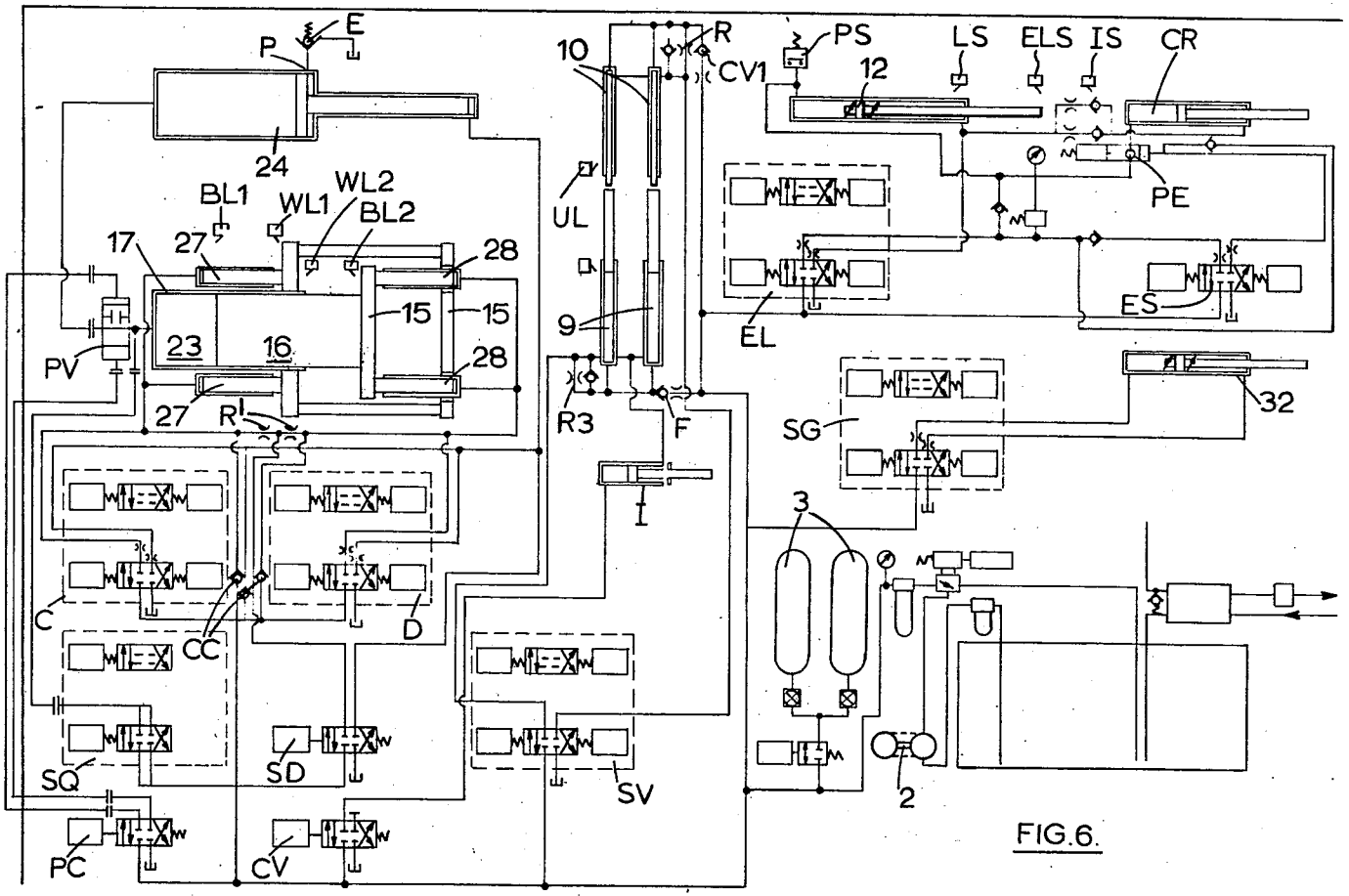
FIG. 6 shows the basic layout of the hydraulic system.

We will now describe the operating cycle of the machine, both the slower and faster versions, with reference to the hydraulic circuit shown in FIG. 6 and the pneumatic circuit shown in FIG. 7. The larger hydraulic valves are pilot-operated and are shown enclosed in rectangles of broken lines, whereas the smaller hydraulic valves are directly operated. Those components which have already been referred to with reference to FIGS. 1 to 5 are indicated by the appropriate reference numerals.

We start with the slider in its lower position and the platens fully retracted. First a solenoidoperated valve SV is energised to admit fluid to the rams 9 to shift the slider 6 upwards. This displaces fluid from the rams 10 and for the greater part of the upward movement the flow from the rams 10 is freely back to tank through ports in the sides of those rams near their upper ends; however, near the upper limit of the travel of the slider, the pistons of the rams 10 cut off these side ports and the final part of the travel is cushioned by the fact that fluid can thereafter only escape from ports in the ends of the rams 10 through a restriction R. The shock that might otherwise arise when the piston cuts off the side part is eliminated by the fact that the end port is not only connected through the restriction R to tank but also through a quick-response check valve CVl to hydraulic supply pressure, so the pressure in the ram cannot rise above supply pressure.

Attainment of the upper position of the slider 6 is detected by a limit switch UL that initiates operation of a clamping valve CV to admit hydraulic line pressure to an intensifier I, which applies extra pressure, for example 3000 p.s.i., to the rams 9 to hold the slider 6 firmly in its upper position.

At the same time the limit switch UL initiates operation of a cylinder advance valve C and a ram advance valve D to the left to admit fluid to the high pressure end of the prefill cylinder 24, displacing a substantial quantity of fluid at low pressure from the low pressure end into the cylinder 17 through a prefill valve PV to move the right-hand pattern plate 15 rapidly into the moulding chamber in the slider 6. This movement displaces fluid from the rams 27 back to tank through the valve C and continues until a limit switch BL1 (which is adjustable in position) shows the pattern plate has reached the right position and centres the valve C, cutting off the path back to tank and therefore halting the movement. At the same time, the left-hand pattern plate is moved in the opposite direction, displacing fluid from the rams 28 until a limit switch BL2 halts it by centering the valve D. Excess pressure in the rams 27 and 28 caused by the shock on closing of the valves C and D is prevented by the provision of connections back to line pressure through check valves CC.

In the meantime the sandgate 31 has been closed under the control of a valve SG, after the required charge of sand has been allowed into the blowing head 30. A prefill control valve PC is energised to shift the prefill valve PV, cutting off the cylinder 17 from the prefill cylinder 24, and a pneumatic valve SS (FIG. 7) admits air to the sandgate seal.

A pneumatic valve MB then opens the valves 34 and 35 to blow the sand into the moulding chamber through the nozzle 36. A hydraulic valve SQ is now energised to admit high pressure fluid to the cylinder 17 and squeeze the resulting mass of sand in the moulding chamber, compacting it into a dense and uniform self-supporting mould.

The pattern plates are then withdrawn initially at a slow rate by the opening of a valve SD which admits high pressure fluid to the rams 27 and 28 through restrictions R, while connecting the high pressure end of the prefill cylinder 24 to tank to allow the fluid in the cylinder 17 to be pushed back into the prefill cylinder 24 through the prefill valve PV, which has in the meantime reverted to its original position. Rather more fluid is pushed back into the prefill cylinder 24 than came from it (because of the fluid that came from the high pressure source during the squeeze) and the surplus escapes back to tank through a spring-loaded check valve E via a port P uncovered at the end of the travel of the piston. The two valves C and D are then both switched simultaneously from their centred positions to their right-hand end positions, allowing the rapid flow of high pressure fluid to the rams 27 and 28, speeding up withdrawal of the pattern plates 15 from the moulding chamber. Withdrawal is halted by limit switches WLl and WL2 and the platens then occupy the position shown in broken lines in FIG. 1.

Separation of the pattern plates from the mould is assisted by the application of reverse air pressure through the vents 39 in the platens.

In the meantime a valve EX in the pneumatic circuit (FIG. 7) has been energised to open a pneumatically controlled exhaust valve EV, venting the blowing head 30. Also the air pressure in the sandgate seal has been released and the sandgate has been opened by the hydraulic ram 32, allowing a further charge of sand into the blowing head 30.

The slider 6 is now free to move down, carrying the newly formed mould. This is done by relieving the upward clamping pressure applied to the rams 9 by the intensifier I and energising the rams 10 through the valve SV. The final part of the downward movement is cushioned in the same way as the earlier upward movement in that at first fluid can escape freely back to tank through the valve SV via side ports near the lower ends of the rams 9 but when these ports have been cut off it can only flow through a restriction R3 to tank and through a check valve F to high pressure supply.

The lower limiting position of the slider is detected by a limit switch DL. This initiates operation of the ejector ram 12 to push the mould out of the moulding chamber by means of the pad 11. We will describe first the slower one of the two alternative cycles mentioned above.

First two valves in parallel, a larger one EL and a smaller one ES are simultaneously energised to provide maximum fluid flow to the ram 12 but after a brief delay the larger one is de-energised so that the ram slows down before the pad 11 engages the mould, and the actual contact is gentle. Contact with the mould results in the build-up of a back-pressure in the ram 12 and this back-pressure is detected by a pressure switch PS which energises the valve EL once again to advance the mould rapidly. After a pre-set advance set by a limit switch ELS (the position of which is adjustable to suit requirements) the valve EL is de-energised and the mould slows down just before it hits the last mould of the existing line of moulds. The engagement with the line of moulds is therefore gentle, avoiding damage to either the newly-formed mould or the existing line. Again pressure builds up, closing pressure switch PS and this time it causes the smaller valve ES to close and to reverse its position, admitting fluid to a pilot valve PE. At the same time the larger valve EL is energised in the same direction as before but this time fluid can flow through it not only to the ejector ram 12 but also, through the pilot valve PE, to a ram CR that advances a conveyor (not shown) on which the whole line of moulds resets. Thus the whole line, including the newly-formed mould, is indexed forwards a distance equal to thickness of one mould, determined by a limit switch IS. At first, after a brief interval the limit switch IS only causes the larger valve EL to close, leaving the smaller valve ES open, so that the line of moulds slows down gently, then valve ES closes as well to halt the line and the valve EL is reversed to retract both rams 12 and CR rapidly back to their starting points. The cycle is now complete and the slider 6 can move up at the start of a fresh cycle.

In the alternative faster cycle the same ejector ram 12 can be used and it only requires that there be an additional limit switch LS to halt the travel of the ram after it has pushed the newly-formed mould out of the slider 6 far enough to clear the slider, then retract the ram. Then as soon as the slider 6 has moved up the ram 12 advances again and this time the behaviour is the same as in the slower cycle, the ram completing its second retraction before the slider comes down with a fresh mould.

It will be understood that there are various interlocks and limit switches which ensure that operation takes place in the correct sequence; these are standard practice and need not be described. Certain other events take place during the cycle and have not been mentioned so far. For example, as the slider is rising, spray nozzles mounted on it spray a parting compound from a reservoir PC (FIG 7) on the patterns 15, under the control of a pneumatic valve PSS. The same valve supplies lubricant to the sandgate 31. In the mould-ejection part of the cycle a pneumatic valve BC opens as the newly-formed mould joins the line, to supply air to nozzles which blow any loose sand clear of the moulds. It is believed that it is not necessary to describe the standard supply-filtering and cooling arrangements for the hydraulic fluid, shown in FIG. 6 nor air supply shown in FIG. 7.

The casting of metal into the line of moulds can follow the method described in our earlier Patent Specification, as can the break-up of the moulds and the recycling of the sand. Cores may be inserted by hand or in the manner forming the subject of my U.S. Pat. No. 3,327,767.

It will be appreciated that it is an easy matter to shift the appropriate limit switches controlling the travel of the various rams so as to alter the thickness of the moulds produced, according to the requirements of the particular patterns being used. In a modification, instead of producing a single mould with pattern impressions in both faces the machine could be used to produce a pair of moulds back-to-back, by the insertion of a loose vertical flat bolster plate in the middle of the moulding chamber. This plate could be retractably mounted on the slider or on the fixed frame and could have limited freedom of movement in the direction of travel of the pattern plates, so as to take up its own position in the moulding chamber and ensure that compaction is equal between the two moulds. The moulds formed by this modification could be a cope and a drag which, after ejection from the slider, are turned to a horizontal position and placed one on top of the other in the manner described in the specification of our Application Serial No. 590,713 filed on the same day as the present application.

The pattern plates may incorporate one or more retractable cores which project through the patterns in directions which make an angle with the direction of movement of the pattern plates, these cores being advanced before the mould is blown and then withdrawn before withdrawal of the pattern plates.

Finally we will describe briefly the arrangements for changing the patterns at the end of a run of one particular form of mould. Although this pattern-changing could be done by hand we prefer to provide automatic means, which are visible in FIGS. 1 and 4. A scissors linkage 45 is movable across the machine on a horizontal rail 46 lying in a plane vertically above the position occupied by each pattern plate 15 in its fully retracted position. Jaws 47 are designed to grasp the pattern plate on extrusion of the linkage, the plate being simultaneously released from the bolster 14 by the withdrawal of locking pins (not shown). Then the linkage is retracted to lift the pattern plate and is traversed to the side of the machine, where the linkage is extended and the jaws 47 release the pattern plate. Another pattern plate can then be picked up and transferred to the machine by movement of the linkage 45 in the reverse order.

In a faster version of this pattern-changing arrangement there are two linkages 45 on each rail so that, as one linkage is lifting the old pattern plate out of the machine the other linkage 45 is simultaneously picking up the new pattern plate and then both linkages are traversed together, so that the new pattern plate can be inserted as the old one is being dropped.

I claim:

1. An automatic machine for the production of flaskless foundry molds, said machine comprising a slider having an aperture therethrough, said slider being movable in a direction transverse to the axis of said aperture between a first position and a second position, opposed first and second pattern plates, said pattern plates being movable into opposite sides of said opening to define therein a molding chamber, in the first position of said slider, fluid-pressure power means acting on said first and second pattern plates to cause said movement, said power means comprising a single fluid-pressure ram assembly having first and second components movable in opposite directions on application of fluid pressure, said first component being connected to said first pattern plate and said second component being connected to said second pattern plate, sand-blowing means adapted to blow sand into said chamber to form a mold therein, and means for ejecting a mold from said opening in the second position of said slider.

2. The machine set forth in claim 1 wherein said ram assembly lies wholly on the same side of said slider as said first pattern plate and including tie rod means connecting said second component to said second pattern plate.

3. The machine set forth in claim 2 wherein said first component comprises a piston and said second component comprises a cylinder in which said piston is movable.

4. The machine set forth in claim 2 wherein said first and second components both comprise pistons and wherein said ram assembly comprises a fixed double-ended cylinder in which said pistons are movable.

5. The machine set forth in claim 1 wherein said means for ejecting a mold from said opening in the second position of said slider comprise an ejector ram working on a fixed axis and including control equipment for said ejector ram, said control equipment including a limit switch defining a position of said ram in which said newly ejected mold is just clear of said slider, and wherein said control equipment is adapted to cause alternate short and long strokes in synchronism with movement of said slider said short strokes being to said limit switch whereby on said short strokes a newly formed mold is ejected just clear of said slider and on said long strokes said mold is displaced further to join and displace a line of previously formed molds, said long strokes being performed with said slider in said upper position.

6. The machine set forth in claim 1 including first and second separate single-acting ram means, said first and second ram means being associated with said first and second pattern plates respectively and being energisable to withdraw said pattern plates from said opening.

7. The machine set forth in claim 6 including fluid ports from said ram means, and restrictions in said fluid ports, said restriction serving to control movement of said pattern plates into said opening by said ram assembly.

8. The machine as set forth in claim 1 wherein said slider is movable vertically, said first position being above said second position.

9. The machine set forth in claim 8 wherein said sand blowing means comprise a fixed sandblowing head, and a nozzle at the lower end of said head co-operating with a slot in the top of said slider.

10. The machine set forth in claim 9 wherein said means for ejecting a newly formed mold comprise an ejector ram working on a fixed axis.

11. The machine set forth in claim 9 wherein said blowing head comprises vents for escape of air from said opening on blowing, said vents lying alongside of said nozzle.

12. The machine set forth in claim 9 wherein said blowing head comprises separate upper and lower air admission regions and separate independently controllable valves admitting air to said upper and lower regions respectively.

* * * * *